US008016290B1

(12) United States Patent
Rhodes

(10) Patent No.: US 8,016,290 B1
(45) Date of Patent: Sep. 13, 2011

(54) FLYING DISK CHALLENGE GAME

(76) Inventor: Gerald A. Rhodes, Jordan, NY (US)

( * ) Notice: Subject to any disclaimer, the term of this patent is extended or adjusted under 35 U.S.C. 154(b) by 0 days.

(21) Appl. No.: 13/005,597

(22) Filed: Jan. 13, 2011

(51) Int. Cl.
*A63B 71/02* (2006.01)

(52) U.S. Cl. ..... 273/317; 273/348

(58) Field of Classification Search ..... 273/317, 273/336, 348, 108, 118 R, 127 R, 127 B; 473/490
See application file for complete search history.

(56) References Cited

U.S. PATENT DOCUMENTS

| | | | | | |
|---|---|---|---|---|---|
| 1,128,194 | A | * | 2/1915 | Smither | 473/569 |
| 1,602,565 | A | * | 10/1926 | Brown | 273/336 |
| 3,226,118 | A | * | 12/1965 | Nehl | 473/414 |
| 3,231,278 | A | * | 1/1966 | Bonlanger | 273/118 A |
| 3,740,036 | A | * | 6/1973 | Ames | 473/569 |
| 3,768,809 | A | * | 10/1973 | Ciarfello | 473/414 |
| 4,293,132 | A | * | 10/1981 | Starr | 273/126 R |
| 4,355,813 | A | * | 10/1982 | Rathjen | 473/473 |
| 4,373,734 | A | * | 2/1983 | Frank | 473/471 |
| 4,819,947 | A | | 4/1989 | Mackey | |
| 5,002,284 | A | | 3/1991 | Butler et al. | |
| 5,016,891 | A | * | 5/1991 | Nelson | 273/407 |
| 5,123,655 | A | | 6/1992 | Rones | |
| 5,199,708 | A | * | 4/1993 | Lucas | 273/126 R |
| 5,318,308 | A | * | 6/1994 | Holms | 273/348.4 |
| 5,362,067 | A | * | 11/1994 | Nelson | 473/589 |
| 5,382,028 | A | | 1/1995 | Sciandra et al. | |
| 5,401,027 | A | | 3/1995 | Surbeck | |
| 5,538,454 | A | * | 7/1996 | Kessler | 446/236 |
| 5,741,194 | A | | 4/1998 | Simunek | |
| 6,237,918 | B1 | * | 5/2001 | Williams | 273/336 |
| 6,241,251 | B1 | * | 6/2001 | Trifonov | 273/339 |
| 6,386,997 | B1 | * | 5/2002 | Brown | 473/490 |
| 6,669,583 | B1 | | 12/2003 | Deppen | |
| 7,192,030 | B1 | * | 3/2007 | Murphy | 273/317 |
| 2002/0067001 | A1 | * | 6/2002 | McClung et al. | 273/317 |
| 2002/0079645 | A1 | * | 6/2002 | Brown | 273/348 |
| 2002/0109291 | A1 | * | 8/2002 | Lawrence | 273/118 R |
| 2003/0184013 | A1 | | 10/2003 | Chodosh | |
| 2006/0066054 | A1 | * | 3/2006 | Menendez | 273/348 |
| 2006/0202424 | A1 | * | 9/2006 | McClung et al. | 273/317 |
| 2006/0267286 | A1 | * | 11/2006 | Hickey | 273/317 |
| 2007/0102884 | A1 | * | 5/2007 | Hinz | 273/348 |
| 2008/0224409 | A1 | * | 9/2008 | Marshall et al. | 273/348 |
| 2010/0001470 | A1 | | 1/2010 | Corrington | |

* cited by examiner

*Primary Examiner* — Raleigh W. Chiu
(74) *Attorney, Agent, or Firm* — Bernhard P. Molldrem, Jr.

(57) ABSTRACT

A flying disk challenge game involves two or more players, each positioned within a boundary ring to define a player position. The players in turn throw or toss a group of colored disks to each other. The disks each have a point value according to its color. The boundary ring may be formed of flexible tubing about five feet in diameter, and given a bright color. The boundary rings are spaced about twenty-five feet apart.

16 Claims, 2 Drawing Sheets

FLYING DISK CHALLENGE GAME

FIELD OF THE INVENTION

The present invention relates to tossing games, and is more particularly directed to flying disk games in which a first player tosses, throws, or sails a disk to a second player who attempts to catch it, and in which the first and second player toss the disks back and forth between each other.

BACKGROUND OF THE INVENTION

Flying disks and flying disk games and sports are well known in general, and typically involve the use of a lightweight flat plastic article of generally round, pie-plate shape and which may be planar or may have a airfoil profile.

The flying disk games are typically played out of doors, e.g., on a field, lawn, or beach, although sometimes on a gymnasium floor or other indoor playing surface. The players stand at positions some distance apart from one another, and toss the disks back and forth between one another, or in some cases at fixed targets or goals. Some goal based games involve a set of spaced bars, bucket, drum or tire. These games usually are played on a lawn or field with each player throwing or tossing the disks, and points may be scored based on the disk reaching the particular target. Some games are disk-based versions of other sports or games, such as tennis or golf.

OBJECTS AND SUMMARY OF THE INVENTION

It is an object of the present invention to provide a disk based game which challenges player's disk throwing and catching skills, and which has high enjoyment and/or entertainment value.

It is another object to provide a game set of disks and related equipment for the disk challenge game.

It is a further object to provide a flying disk game that may be played by two players, by more than two players, or by two teams of players.

In accordance with an aspect of the present invention, a flying disk yard game involves two or more players, employing a game set formed of a group of flying disks and player positioning rings. The flying disks are adapted to be thrown by hand by a first player and caught by hand by a second player, with the flying disks being generally flat articles, and formed of a durable semi-rigid plastic resin material. The disks each have a respective colorant additive included in the plastic resin material thereof such that the disks of the group are respective different colors. As used in this description, the term "color" is meant to include black, white, and gray as well as various primary and intermediate colors. The color can be applied uniformly to each disk, or may be in the form of stripes or rings on the disks. In one preferred example, the disks are about eight inches in diameter, and there is one disk each in green, blue, yellow, red, and black, with point values as follows: green—4 points, blue—3 points, yellow—2 points, red—2 points, and black—1 point. There are two or more player positioning boundary rings each formed of a flexible tubing having ends that are joined together to form the ring, such that each said ring has a predetermined diameter D (e.g., five feet or 150 cm) suitable to define a player position. A smaller ring can be used for young children. The game is set up by placing the player positioning rings on a playing field such that the rings are spaced apart a predetermined distance S, e.g., about 25 feet or 8 meters. The first player stands in a first one of the rings and the second player standing in the second one of the rings. Then the first player throwing all the disks of the group, one after another, towards the second player's position. The second player attempts to catch each of the disks without stepping outside the ring. Points are awarded to one player or the other based on the point values for respective color disks, and based on whether each given disk was caught by the second player while standing in the boundary ring (or whether the disk is deemed catchable by passing through a zone over the second player's ring or landing within it).

Each player's positioning ring is considered to define a cylindrical zone extending from the playing field up above the player. Points may be awarded based on the color of the disk, to the first player if the disk lands within the zone or passes through the zone and the second player fails to catch the disk, or to the second player if that player catches the disk without leaving the ring, or if a throw misses, i.e., if the disk fails to pass into or through the cylinder or zone.

According to another aspect, the invention is directed to a flying disk challenge game set, comprising the equipment needed to play this game. The game set equipment includes at least one group of colored flying disks, e.g., the five colored disks as described. There may be disks of other colors included as well, and there can be several groups of the colored disks for multiple-player versions of the game. The game set also includes two or more player positioning rings each formed of a flexible tubing, with plugs, dowels, or similar means for joining the ends thereof together into a ring. Each ring may involve three lengths of tubing. The rings each having a predetermined diameter D, e.g., five feet.

A rule set is also provided together with the disks and rings. This may be printed on a rule sheet, or the rules of play may be imprinted on the storage box or one or more of the disks. These rules include instructions for setting up the positioning rings, and for how the disks are thrown and how points are awarded to the players, based on colors of disks, and on whether the disk is caught if it passes, as intended, to or through the second player's zone. Alternatives and variations of the rules can be provided for multiple players, for teams of players, or special rules for small children.

BRIEF DESCRIPTION OF THE DRAWINGS

The present invention will be understood and appreciated more fully from the following detailed description taken in conjunction with the drawings wherein.

DETAILED DESCRIPTION OF THE PRESENT INVENTION

Figure 1:
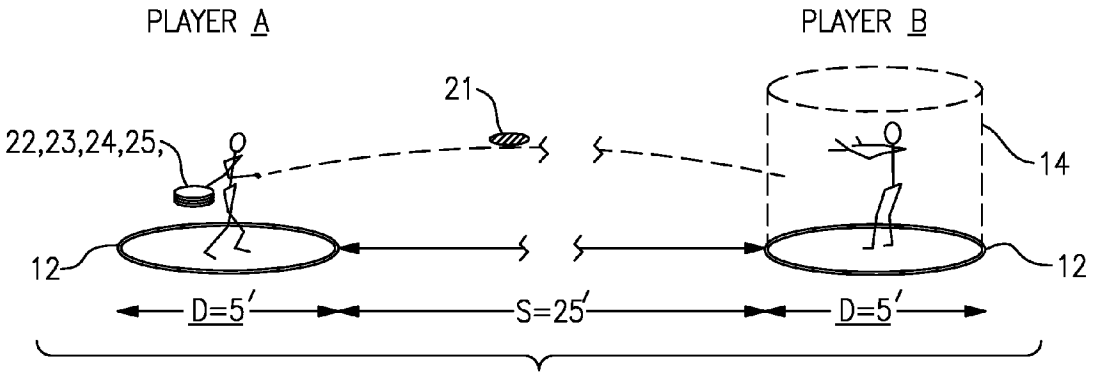
FIG. 1 is a perspective for explaining the play of the flying disk challenge game between two players.

Referring now to FIG. 1, the game of disk challenge is played here with two players, each standing in a playing area defined by a boundary ring 12, which in this case each have a diameter of about five feet (i.e., about 150 to 160 cm). The rings 12 are laid out on a field or lawn, and spaced apart a predetermined spacing distance S, which in this embodiment is about twenty-five feet (i.e., about seven to eight meters). The play starts with one player (here, player A, shown at the left) holding a set of disks, and tossing them to the other player (player B) one disk at a time, while players A and B are each standing within their respective boundary ring. Here a first disk 21 is shown in the air while the player A is holding the remaining four disks 22, 23, 24 and 25. As shown in broken line with respect to player B, the boundary disk 12 defines a generally cylindrical zone 14 that extends up from the ring 12 to a position a foot or two above the head of player B. The tossed disk 21 is considered catchable if it passes into this cylindrical zone 14, or if it lands on the ground within the ring 12.

Figure 2:
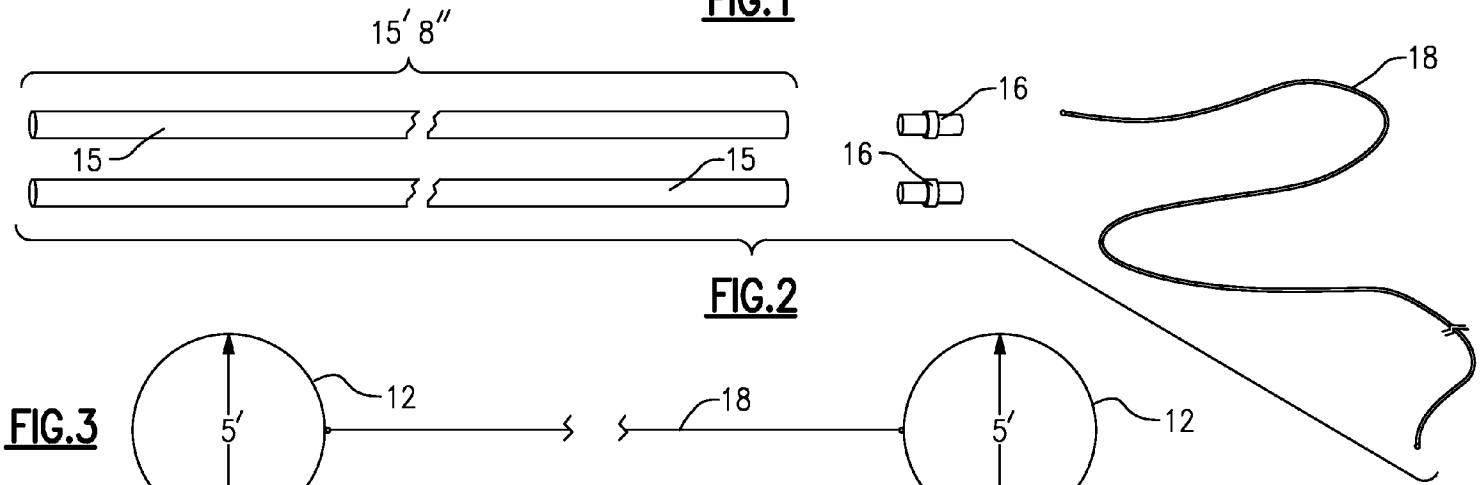
FIG. 2 shows other game equipment as employed in the flying disk challenge game.
Figure 3:
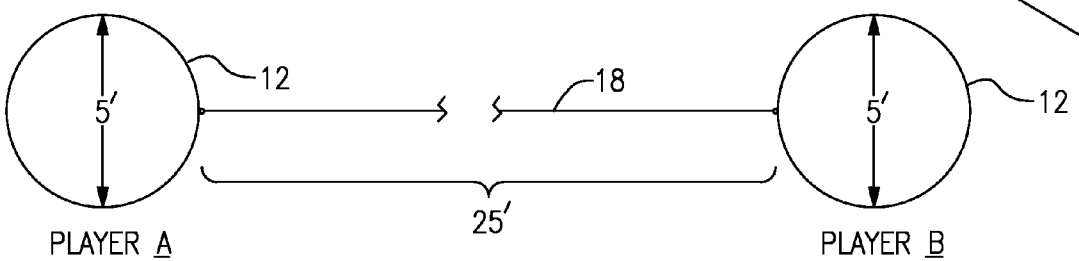
FIG. 3 is a plan view of a set up of the positioning rings, in accordance with a preferred embodiment of the present invention.

As shown in FIG. 2, each positioning ring or boundary ring 12 is formed of one or more lengths of flexible plastic tubing 15, with a dowel or plug 16 that fits into opposite ends of the tubing 15 to form the ring. In practice, each ring could be made of three (or more) shorter lengths of tubing joined end to end in this fashion. The total length of tubing should be about fifteen feet, eight inches so that the ring diameter is about five feet. As many rings 12 are provided as there are players. Although only two players are involved in this example, the disk challenge game may be played with three, four, or more players or with two or more teams of players. The rings 12 may be colored bright orange so they are clearly visible on a green lawn or field. As further shown in FIG. 2, the game set may also include a cord or string 18 of twenty-five feet in length that is used to set the two rings 12 at the predetermined spacing distance S (twenty-five feet) apart, as illustrated in FIG. 3.

Figure 4:
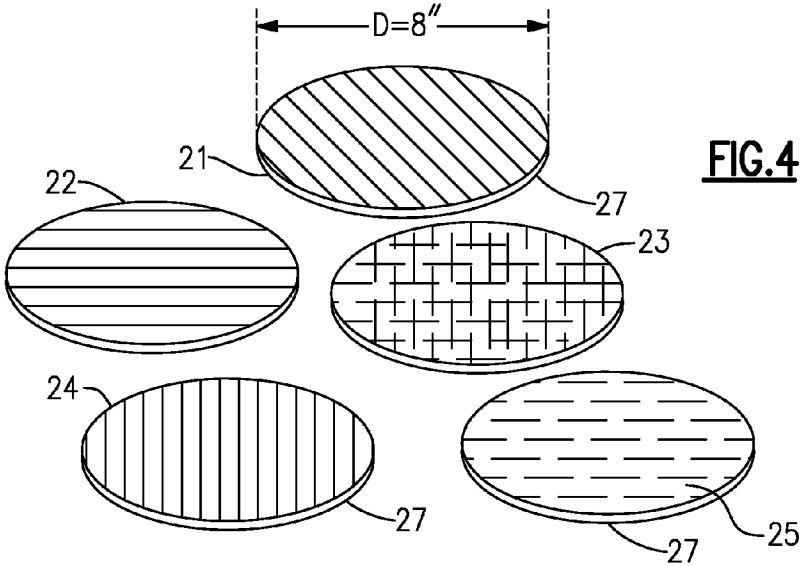
FIG. 4 is a perspective view of the group of disks used in the flying disk challenge game of the preferred embodiment.

The disks are provided as a group of fliers or flying disks, as shown in FIG. 4, each disk in the group being a different distinctive color. The disks 21 to 25 are each made of a semi-rigid plastic material, e.g., polyethylene, and favorably with a soft feel or texture to facilitate catching and throwing. Each disk is generally flat, i.e., planar in some cases or with an airfoil shape in cross section, as preferred by players. In this case, the five disks 21 to 25 of the group each have a diameter of about eight inches (twenty cm), and each has a different color. Favorably the color is in the form of a dye or colorant added to the plastic resin material. In FIG. 4, the disks are shown as lined to represent different colors, with disk 21 being green, disk 22 blue, disk 23 yellow, disk 24 red, and disk 25 black.

In a preferred embodiment, each disk is eight inches in diameter and has a circular outer flange 27 at its bottom side edge, i.e., at the rim, with a depth of about five-eighths inch. Favorably the plastic material in the disk has a luminescent or glow-in-the-dark additive so that the flying disk challenge game can be played in evening darkness for added enjoyment. The boundary rings 12 may also contain a glow-in-the dark additive, or may have battery-powered illumination.

Figure 5:
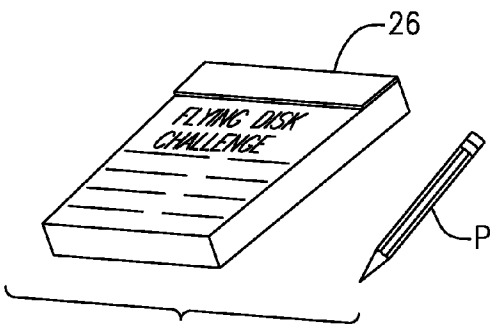
FIG. 5 is a perspective view of additional equipment provided.

One or more score pad 26 may be provided, with a pencil or pen P, as shown in FIG. 5.

Figure 6:
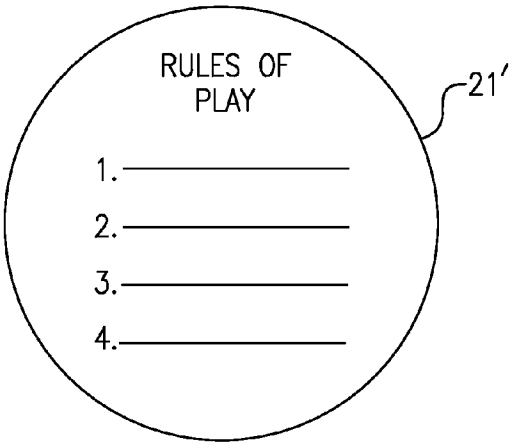
FIG. 6 shows the game rules of play here printed onto one of the game disks.

Rules of play are provided with the game set, and these may be printed on a rule sheet, or on a panel of the box or container for the game set. In this example shown in FIG. 6, one disk 21' has the rules of play imprinted on it.

In a preferred mode of play, the two players first determine the order of play, and one is the first to be the throwing player (i.e., player A) while the other is the catching player (i.e., player B). Each player is standing within the player position as defined by the respective five-foot boundary ring 12. Player A then throws one disk at a time, in an order chosen by player A. The disks pass through the air towards the second player, i.e., player B. Player B attempts to catch each disk as it reaches the zone 14. Player B has to remain standing inside the ring 12 when making a legal catch. Each disk has a score value based on its color, and in the preferred mode of play the green disk 21 has a value of 4 points, the blue disk 22—3 points, the yellow disk 23—2 points, the red disk 24—2 points, and the black disk 25—1 point. The catching player B obtains points for legal catches of the disks, and then records the total score for that turn on one of the score pads 26. Then player B throws the group of disks, one at a time, to player A, who receives scoring points in similar fashion. The first player to reach a predetermined total amount, e.g., 65 points, after both players have had a turn, is the winner. If there is a tie, the players may continue until one has a higher score than the other.

Points may also be scored by the throwing player, if a disk is considered catchable, but the catching player fails to catch it legally. For example if player A throws a disk that passes through the zone 14 for player B, but player B does not catch it, then player A can be awarded the points represented by the disk color. Likewise, if player A throws a disk that does not reach the zone 14 for player A nor does the disk land on the surface within the ring 12, then the catching player B may receive the points for the disk according to its color. If the catching player B steps over the ring 12 to make a catch, that catch is not counted.

Various changes and modifications, other than those described above in the preferred embodiment of the invention described herein will be apparent to those skilled in the art. While the invention has been described with respect to certain preferred embodiments and exemplifications, it is not intended to limit the scope of the invention thereby, but solely by the claims appended hereto.

I claim:

1. A flying disk challenge game set, comprising at least one group of flying disks adapted to be thrown and caught by hand, the disks each being generally flat and formed of a durable semi-rigid plastic resin material, the disks each having a colorant included in the plastic resin material thereof such that the disks of the group are of respective different colors;

two or more player positioning rings each formed of a flexible tubing having ends, including means joining the ends thereof together, the rings each having a predetermined diameter D suitable to define a player position in which a player stands during play of the game; and a rule set provided together with the disks and rings, and imprinted with rules of play to establish scoring based on colors of the respective disks.

2. The flying disk challenge game set of claim 1 comprising a distance-measuring cord of a predetermined length S for establishing said length S as a separation distance between any two of said player positioning rings.

3. The flying disk challenge game set of claim 1 wherein said disks are soft-textured disks of substantially eight-inch diameter.

4. The flying disk challenge game set of claim 3 wherein each said disk has a circular edge flange at its lower side.

5. The flying disk challenge game set of claim 1 wherein each said group of disks includes five (5) disks of respective different colors, and wherein said rule set includes a scoring rule giving each disk a respective point value based on its color.

6. The flying disk challenge game set of claim 5 wherein each said group includes one disk of each of the following colors: green, blue, yellow, red, and black.

7. The flying disk challenge game set of claim 5 wherein each said disk is formed of a glow-in-the-dark material.

8. The flying disk challenge game set of claim 1 wherein the diameter D of each said player positioning ring is substantially five (5) feet.

9. The flying disk challenge game set of claim 1 wherein each said player positioning ring is formed of a glow-in-the-dark material.

10. A method of playing a flying disk yard game between two or more players, employing a game set which includes a group of flying disks each adapted to be thrown by hand by a first player and caught by hand by a second player, the disks being generally flat and formed of a durable semi-rigid plastic resin material, the disks each having a respective colorant included in the plastic resin material thereof such that the disks of the group are of respective different colors; and two or more player positioning ring assemblies adapted to be formed into a positioning ring, each formed of a length of flexible tubing having ends that are adapted to be joined together to form the ring such that each said ring has a predetermined diameter D suitable to define a player position;

the method of playing comprising:

joining opposite ends of the respective lengths of flexible tubing to form said player positioning rings of said predetermined diameter D;

placing said player positioning rings on a playing field such that the rings are spaced apart a predetermined distance S;

the first player standing in a first one of said rings and the second player standing in a second one of said rings;

the first player, while standing in the first one of said rings, throwing each of the several disks of said group, one after another, towards the second player;

the second player attempting to catch each of said disks while standing within the second one of said rings; and awarding points to said first and second players based on a predetermined point value for respective colors of the disks, and based on whether each given disk was caught by the second player while standing in the second one of the rings.

11. The method of playing a flying disk yard game according to claim 10 wherein said predetermined diameter D is substantially five feet and said distance S is substantially twenty-five feet.

12. The method of playing a flying disk yard game according to claim 10 wherein said group of disks includes five disks of respective different colors, and the point value of each disk depends on the specific color of the disk.

13. The method of playing a flying disk yard game according to claim 10 wherein at least the second one of the positioning rings defines a cylindrical zone extending from the playing field up above the second player, and for each disk thrown by the first player, a number of points based on the color of the disk is awarded to the first player if the disk lands within the zone or passes through the zone and the second player fails to catch the disk.

14. The method of playing a flying disk yard game according to claim 13 wherein each said disk has a respective point value according to its color.

15. The method of playing a flying disk yard game according to claim 10 wherein at least the second one of the positioning rings defines a cylindrical zone extending from the playing field up above the second player; and for each disk thrown by the first player the second player is awarded a number or points based on the color of the disk if the disk fails to pass into or through said zone.

16. The method of playing a flying disk yard game according to claim 10, wherein said step of joining the ends of the respective lengths of tubing includes inserting a plug into opposite ends of said length of tubing to form said player positioning ring.

* * * * *